US011647799B2

(12) United States Patent
Randlett et al.

(10) Patent No.: US 11,647,799 B2
(45) Date of Patent: May 16, 2023

(54) FACE SHIELD ASSEMBLY

(71) Applicant: Ford Global Technologies, LLC, Dearborn, MI (US)

(72) Inventors: Doug H. Randlett, Metamora, MI (US); Christopher Charles Hunt, Livonia, MI (US); Howard Lew, Canton, MI (US); Kristina Karschnia, St. Clair Shores, MI (US); Todd Jaranowski, Milford, MI (US); Paul Kenneth Dellock, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 299 days.

(21) Appl. No.: 16/983,386

(22) Filed: Aug. 3, 2020

(65) Prior Publication Data

US 2022/0030978 A1 Feb. 3, 2022

(51) Int. Cl.
*A41D 13/11* (2006.01)

(52) U.S. Cl.
CPC ..... *A41D 13/1184* (2013.01); *A41D 13/1161* (2013.01)

(58) Field of Classification Search
CPC ..... A41D 13/1161; A41D 13/1184; A41D 13/11; G02C 3/003
See application file for complete search history.

(56) References Cited

U.S. PATENT DOCUMENTS

| | | | | |
|---|---|---|---|---|
| 5,313,671 | A * | 5/1994 | Flory | A63B 33/008 351/149 |
| 5,390,373 | A * | 2/1995 | Flory | A63B 33/006 2/430 |
| 6,301,719 | B1 | 10/2001 | Goodhand et al. | |
| 6,370,695 | B2 | 4/2002 | Paris et al. | |
| 6,564,804 | B2 | 5/2003 | Salatka et al. | |
| 6,854,128 | B1 | 2/2005 | Faulk | |
| 6,990,981 | B2 | 1/2006 | DuBois et al. | |
| 7,007,306 | B2 | 3/2006 | Howard et al. | |
| D526,446 | S | 8/2006 | Cowan et al. | |
| D533,316 | S | 12/2006 | Canavan et al. | |
| 7,178,931 | B1 | 2/2007 | Murphy | |
| D539,987 | S | 4/2007 | Love | |
| D544,679 | S | 6/2007 | Almeida | |
| D563,603 | S | 3/2008 | Huh et al. | |
| 7,389,543 | B2 | 6/2008 | Reichow et al. | |
| 7,406,964 | B2 | 8/2008 | Diaz | |
| 7,418,740 | B2 | 9/2008 | Anderson et al. | |
| 7,490,359 | B2 | 2/2009 | Landis | |
| 7,520,630 | B2 | 4/2009 | Murphy | |
| D598,610 | S | 8/2009 | Soukup et al. | |

(Continued)

FOREIGN PATENT DOCUMENTS

| | | |
|---|---|---|
| CA | 2386043 | 11/2003 |
| CA | 2572727 | 2/2006 |

(Continued)

*Primary Examiner* — F Griffin Hall
(74) *Attorney, Agent, or Firm* — David B. Kelley; Carlson, Gaskey & Olds, P.C.

(57) ABSTRACT

A face shield assembly includes, among other things, a shield configured to be placed adjacent a front of a head of a user, a tube configured to be placed against a rear of the head of the user, and fasteners. Each of the fasteners binds the tube to at least the shield.

7 Claims, 4 Drawing Sheets

(56) References Cited

U.S. PATENT DOCUMENTS

| | | | | |
|---|---|---|---|---|
| D615,119 | S | 5/2010 | Palmer et al. | |
| 7,725,949 | B2 * | 6/2010 | Landis | A61F 9/045 2/9 |
| 7,735,156 | B2 | 6/2010 | VanDerWoude et al. | |
| 7,752,682 | B2 | 7/2010 | VanDerWoude et al. | |
| 7,774,858 | B2 | 8/2010 | Kayerod | |
| 7,814,578 | B2 | 10/2010 | Kosel et al. | |
| 7,850,303 | B2 | 12/2010 | Reichow et al. | |
| D638,169 | S | 5/2011 | Lebel et al. | |
| 7,937,775 | B2 | 5/2011 | Manzella, Jr. et al. | |
| D645,211 | S | 9/2011 | Hill | |
| 8,020,552 | B2 | 9/2011 | Dillon et al. | |
| 8,070,288 | B2 | 12/2011 | Heyman et al. | |
| D652,574 | S | 1/2012 | Stoll | |
| 8,104,891 | B2 | 1/2012 | Reichow et al. | |
| 8,166,575 | B2 | 5/2012 | Haselmayer | |
| 8,185,969 | B2 | 5/2012 | Chang | |
| D662,672 | S | 6/2012 | Carlborg et al. | |
| 8,196,224 | B2 | 6/2012 | Manzella, Jr. et al. | |
| 8,225,421 | B1 | 7/2012 | Froissard | |
| 8,234,722 | B2 | 8/2012 | VanDerWoude et al. | |
| 8,272,070 | B2 | 9/2012 | Brown et al. | |
| 8,282,234 | B2 | 10/2012 | VanDerWoude et al. | |
| 8,291,512 | B2 | 10/2012 | Stoll | |
| 8,336,123 | B2 | 12/2012 | Gleason et al. | |
| 8,359,662 | B2 | 1/2013 | Viljanen | |
| 8,375,474 | B2 | 2/2013 | Arai | |
| 8,387,163 | B2 | 3/2013 | Beliveau | |
| D681,282 | S | 4/2013 | Dente | |
| 8,407,818 | B2 | 4/2013 | VanDerWoude et al. | |
| 8,434,167 | B2 | 5/2013 | Gleason et al. | |
| 8,434,168 | B2 | 5/2013 | Paulson | |
| D684,321 | S | 6/2013 | Gill | |
| 8,458,812 | B2 | 6/2013 | Kayerod | |
| 8,458,813 | B2 | 6/2013 | Grad et al. | |
| 8,564,503 | B2 | 10/2013 | Righi et al. | |
| 8,677,517 | B1 | 3/2014 | Morency et al. | |
| 8,678,582 | B2 | 3/2014 | Reichow et al. | |
| 8,875,318 | B2 | 11/2014 | Huh | |
| 8,899,867 | B2 | 12/2014 | Tatomir | |
| D720,891 | S | 1/2015 | Gill | |
| 8,955,168 | B2 | 2/2015 | Manzella, Jr. et al. | |
| D726,378 | S | 4/2015 | Wako | |
| 9,004,801 | B2 | 4/2015 | Tatomir | |
| D730,584 | S | 5/2015 | Paulson | |
| D732,242 | S | 6/2015 | Miller et al. | |
| D734,538 | S | 7/2015 | Sybydlo et al. | |
| 9,277,780 | B2 | 3/2016 | Hillion | |
| D759,900 | S | 6/2016 | Cummings et al. | |
| 9,408,429 | B2 | 8/2016 | Tatomir | |
| 9,427,288 | B1 | 8/2016 | Chenger et al. | |
| 9,532,617 | B2 | 1/2017 | Miller et al. | |
| 9,681,698 | B2 | 6/2017 | Tatomir | |
| 9,700,093 | B2 | 7/2017 | Gamache et al. | |
| 9,855,171 | B2 | 1/2018 | York | |
| 9,894,952 | B2 | 2/2018 | Hayes | |
| 9,895,592 | B2 | 2/2018 | Emard | |
| 9,949,517 | B2 | 4/2018 | Howard | |
| 9,980,529 | B1 | 5/2018 | Hajianpour | |
| 10,022,273 | B2 | 7/2018 | Huh | |
| 10,052,233 | B2 | 8/2018 | Yang et al. | |
| D829,384 | S | 9/2018 | Paulson | |
| 10,076,149 | B2 | 9/2018 | Ross et al. | |
| 10,098,403 | B2 | 10/2018 | Sommers et al. | |
| D834,756 | S | 11/2018 | Paulson | |
| 10,136,693 | B1 | 11/2018 | Paulson | |
| 10,231,495 | B2 | 3/2019 | Nabai | |
| 10,286,287 | B2 | 5/2019 | King | |
| 10,307,217 | B2 | 6/2019 | Sparkuhl | |
| D853,656 | S | 7/2019 | Martin et al. | |
| 10,357,401 | B2 | 7/2019 | Hsu et al. | |
| 10,384,084 | B2 | 8/2019 | Isham et al. | |
| 10,398,601 | B2 | 9/2019 | Cornelius et al. | |
| 10,420,386 | B1 | 9/2019 | Jefferis et al. | |
| 10,449,397 | B2 | 10/2019 | VanDerWoude et al. | |
| D869,096 | S | 12/2019 | Langlois et al. | |
| D876,020 | S | 2/2020 | Langlois et al. | |
| D879,383 | S | 3/2020 | Bowen | |
| 10,603,217 | B2 | 3/2020 | Spier | |
| 2008/0249779 | A1 | 10/2008 | Hennecke | |
| 2008/0263326 | A1 | 10/2008 | Rasche et al. | |
| 2015/0223548 | A1 | 8/2015 | Okuma et al. | |
| 2016/0331059 | A1 | 11/2016 | Basson et al. | |
| 2017/0000207 | A1 | 1/2017 | Hajianpour | |
| 2017/0042274 | A1 | 2/2017 | Tatomir | |
| 2017/0079364 | A1 | 3/2017 | Paulson | |
| 2017/0368415 | A1 * | 12/2017 | Pierce | A63B 33/002 |
| 2018/0042311 | A1 | 2/2018 | Carraro | |
| 2018/0084848 | A1 | 3/2018 | Pavalarajan et al. | |
| 2018/0228652 | A1 | 8/2018 | Ohura | |
| 2018/0343938 | A1 | 12/2018 | Koros et al. | |
| 2018/0368505 | A1 | 12/2018 | Kidman et al. | |
| 2019/0133238 | A1 | 5/2019 | Tsai | |
| 2019/0174860 | A1 | 6/2019 | VanderWoude et al. | |
| 2019/0175410 | A1 | 6/2019 | Eliseo | |
| 2019/0209912 | A1 | 7/2019 | Isserow et al. | |
| 2019/0231005 | A1 | 8/2019 | Jefferis et al. | |
| 2019/0274885 | A1 | 9/2019 | Huh | |
| 2019/0350294 | A1 | 11/2019 | Paiz | |
| 2020/0001123 | A1 | 1/2020 | VenDerWoude et al. | |
| 2020/0068980 | A1 | 3/2020 | Langlois et al. | |

FOREIGN PATENT DOCUMENTS

| | | |
|---|---|---|
| CA | 2602821 | 9/2006 |
| CA | 2845907 | 9/2006 |
| CA | 2615192 | 1/2007 |
| CA | 2812712 | 1/2007 |
| CA | 2678070 | 9/2008 |
| CA | 133964 | 9/2010 |
| CA | 137375 | 4/2011 |
| CA | 135263 | 10/2011 |
| CA | 135264 | 10/2011 |
| CA | 139823 | 11/2011 |
| CA | 2770226 | 9/2012 |
| CA | 2776493 | 11/2012 |
| CA | 2802381 | 7/2013 |
| CA | 2870148 | 11/2013 |
| CA | 158101 | 7/2015 |
| CA | 2852446 | 11/2015 |
| CA | 183212 | 5/2019 |
| CA | 183213 | 5/2019 |
| CH | 717562 A2 * | 12/2021 |

* cited by examiner

FACE SHIELD ASSEMBLY

TECHNICAL FIELD

This disclosure relates generally to a face shield assembly and, in particular, a face shield assembly that is relatively easy to resize.

BACKGROUND

A face shield is a type of personal protective equipment (PPE). A user can wear a face shield to protect their face and associated mucous membranes (e.g., eye, nose, and mouth membranes) from, for example, a spray, splash, or spatter of bodily fluids. A face shield can instead or additionally protect the user from other things, such as airborne debris or chemical splashes.

SUMMARY

A face shield assembly according to an exemplary aspect of the present disclosure includes, among other things, a shield configured to be placed adjacent a front of a head of a user, a tube configured to be placed against a rear of the head of the user, and fasteners. Each of the fasteners binds the tube to at least the shield.

In another example of the foregoing assembly, the fasteners extend into an interior of the tube when binding the tube to at least the shield.

In another example of any of the foregoing assemblies, the fasteners each extend through a respective aperture in the shield.

In another example of any of the foregoing assemblies, the fasteners are push-in rivets.

Another example of any of the foregoing assemblies includes a bumper configured to be placed against the front of the head of the user.

In another example of any of the foregoing assemblies, the bumper is a foam material.

In another example of any of the foregoing assemblies, the tube is an elastic tube.

In another example of any of the foregoing assemblies, the tube extends longitudinally from a first end face to a second end face. The first and second end faces directly contact the shield when the fasteners are binding the tube to at least the shield.

In another example of any of the foregoing assemblies, the first and second end faces directly contact an inner surface of the shield when binding the tube to at least the shield. The inner surface of the shield faces the head of the user when the user is wearing the face shield assembly.

A face shield assembly method according to yet another exemplary aspect of the present disclosure includes a step of inserting a shaft of a fastener through an aperture in a shield of a face shield assembly, and positioning the shaft of the fastener at least partially within an interior of a tube to bind the tube to at least the shield.

Another example of the foregoing method includes stretching the tube along a back of a head of a user when the user is wearing the face shield assembly.

Another example of any of the foregoing methods includes, prior to the inserting and positioning, changing a length of the tube.

Another example of any of the foregoing methods includes withdrawing the shaft of the fastener from the interior of the tube, cutting the tube to provide a shorter tube, and then reinserting the shaft of the fastener into the shorter tube.

In another example of any of the foregoing methods, the fastener is a push-in rivet.

Another example of any of the foregoing methods includes adhesively securing a bumper to the shield, the bumper configured to be placed against the front of the head of the user.

Another example of any of the foregoing methods includes wearing the face shield assembly by placing the shield adjacent a front of a head of a user. The bumper is placed against the front of the head of the user, and the tube against a rear of the head of the user.

In another example of any of the foregoing methods, the tube extends longitudinally from a first end face to a second end face. The first end face directly contacts the shield when the fastener is binding the tube to at least the shield.

In another example of any of the foregoing methods, the tube is an elastic tube.

A face shield assembly according to another exemplary aspect of the present disclosure includes a shield configured to be placed adjacent a front of a head of a user, a bumper configured to be placed against a forehead of the user, and an elastic tube configured to be placed against a rear of the head of the user. The elastic tube includes an interior extending from a first end of the elastic tube to an opposite, second end of the elastic tube. A first fastener has a first fastener shaft that extends into the interior of the elastic tube from the first end of the elastic tube to bind the first end of the elastic tube to the shield. A second fastener has a second fastener shaft that extends into the interior of the elastic tube from the second end of the elastic tube to bind the second end of the elastic tube to the shield.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure details a face shield assembly and a face shield assembling method. If the face shield assembly is too large for a user to wear, the face shield assembly can be adjusted to fit the user.

Figure 1:
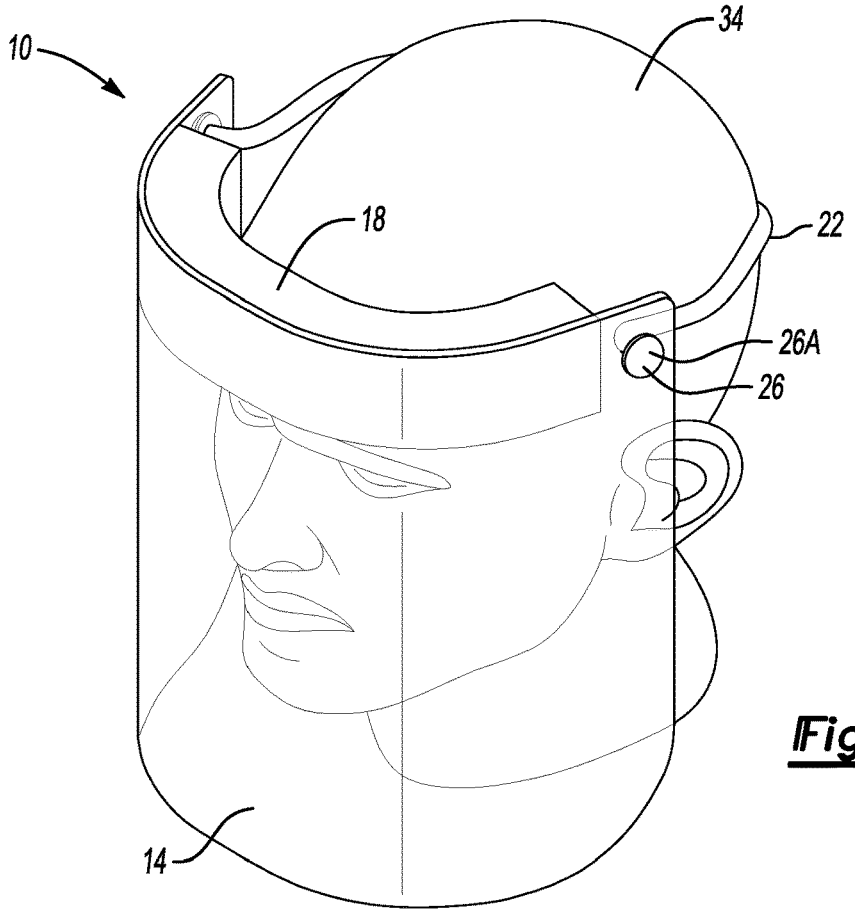
FIG. 1 illustrates a perspective view of a user wearing a face shield assembly according to an exemplary aspect of the present disclosure.
Figure 2:
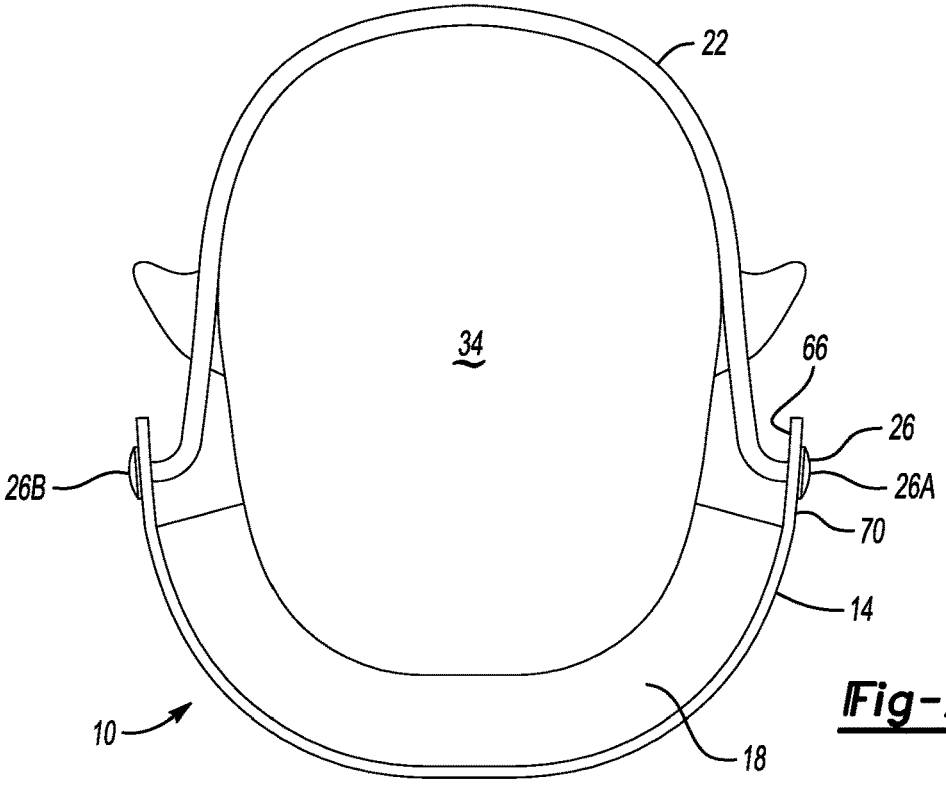
FIG. 2 illustrates a top view of the user wearing the face shield assembly of FIG. 1.

With reference to FIGS. 1 and 2, a face shield assembly 10 according to an exemplary embodiment of the present disclosure includes a shield 14, a bumper 18, a tube 22, and at least one fastener 26. A user can place the face shield assembly 10 on their head 34 to protect the user from, for example, a spray of bodily fluids expelled from another person.

Figure 3:
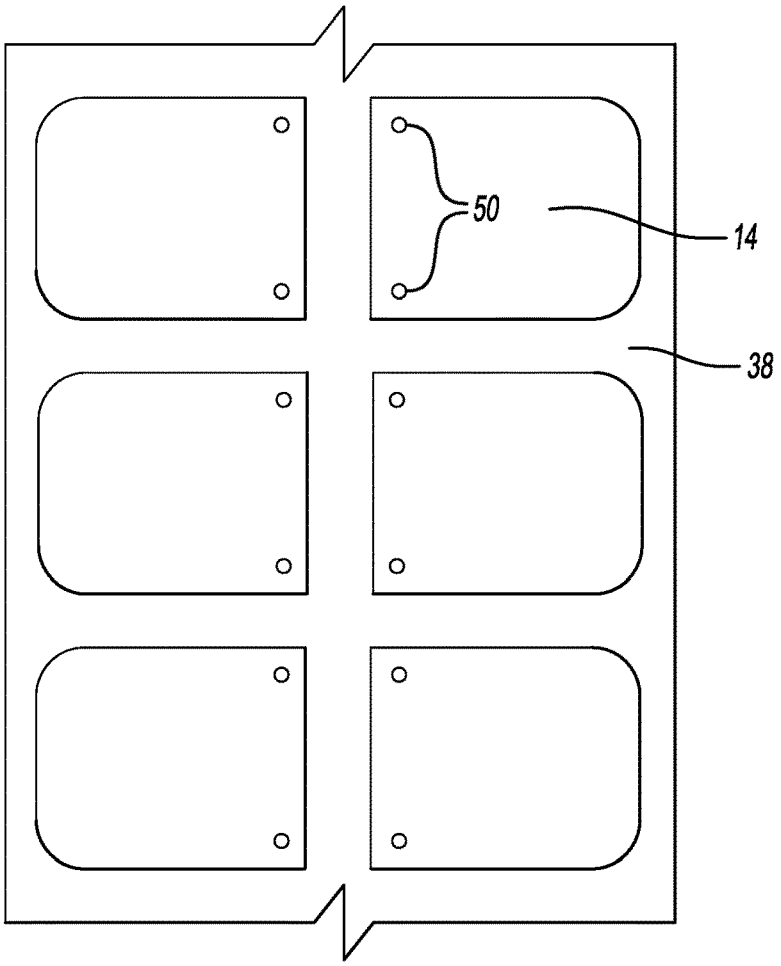
FIG. 3 illustrates a sheet of material after a stamping operation.

The shield 14 can be a transparent or semi-transparent polymer or polymer-based material that is antimicrobial. In a specific example, the shield 14 is a polyethylene terephthalate (PET), which can be cleaned and is relatively strong and lightweight. In other examples, the shield 14 can be polycarbonate, acrylic, or some other type of clear plastic. The shield 14 can be from 0.012 to 0.016 inches thick. The user can look through the shield 14 when the user is wearing the face shield assembly 10. As shown in FIG. 3, multiple shields 14 can be die cut from a single sheet 38 of polymer or polymer-based material.

The shield 14 can be a transparent or semi-transparent polymer or polymer-based material that is antimicrobial. In a specific example, the shield 14 is a polyethylene terephthalate (PET), which can be cleaned and is relatively strong and lightweight. In other examples, the shield 14 can be polycarbonate, acrylic, or some other type of clear plastic. The shield 14 can be from 0.012 to 0.016 inches thick. The user 30 can look through the shield 14 when the user 30 is wearing the face shield assembly 10. As shown in FIG. 3, multiple shields 14 can be die cut from a single sheet 38 of polymer or polymer-based material.

The bumper 18 can be an open cell urethane foam, such as polyurethane density 1.1 foam. The bumper 18 can be an antimicrobial. In another example, the bumper is an antimicrobial closed cell foam. Using closed cell foam rather than, for example, an open cell foam, can enhance cleanability. The bumper 18, in the exemplary embodiment, is adhesively secured to the shield 14. A pressure sensitive adhesive, for example, could be used to attach the bumper 18 to the shield 14.

The tube 22 can be an antimicrobial elastic material that stretches and lengthens as the user places the face shield assembly 10 on their head 34. The tube 22, when stretched, helps to hold the face shield assembly 10 on the head 34 of the user. The tube 22 can have a 0.25 inch or 6.3 millimeter diameter.

The fasteners 26, in the exemplary embodiment, each secure an end of the tube 22 to the shield 14. In this example, the face shield assembly 10 includes a first fastener 26A and a second fastener 26B. When the user is wearing the face shield assembly 10, the first fastener 26A is disposed adjacent a left temple of the head 34. The second fastener 26B is spaced a distance from the first fastener 26A and is disposed adjacent a right temple of the head 34.

Figure 4:
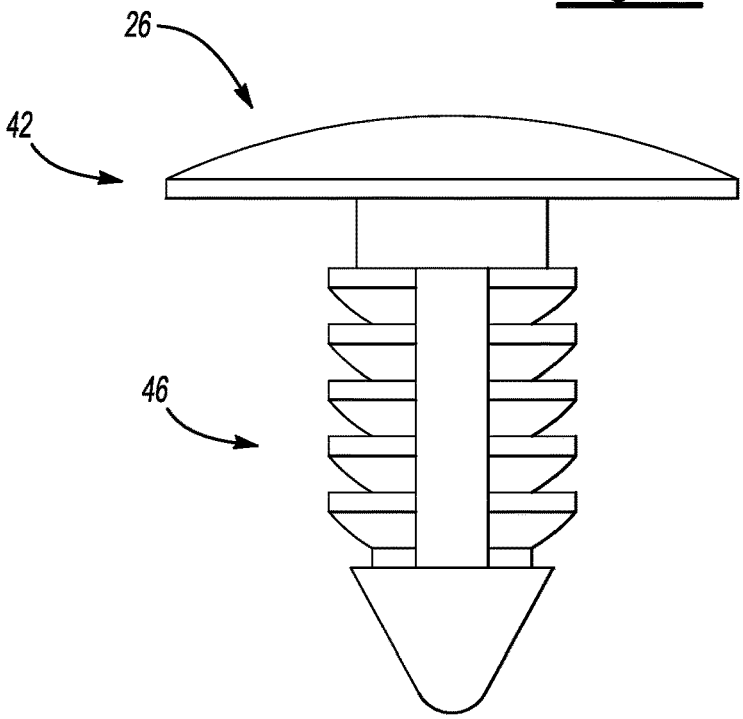
FIG. 4 illustrates a side view of a fastener from the face shield assembly of FIG. 1.

The fasteners 26 can be push-in rivets having a fastener head 42 and a ribbed shank 46 as shown in FIG. 4. Push-in rivets can sometimes be referred to as push-in fasteners, push rivets, or Christmas tree fasteners.

Figure 5:
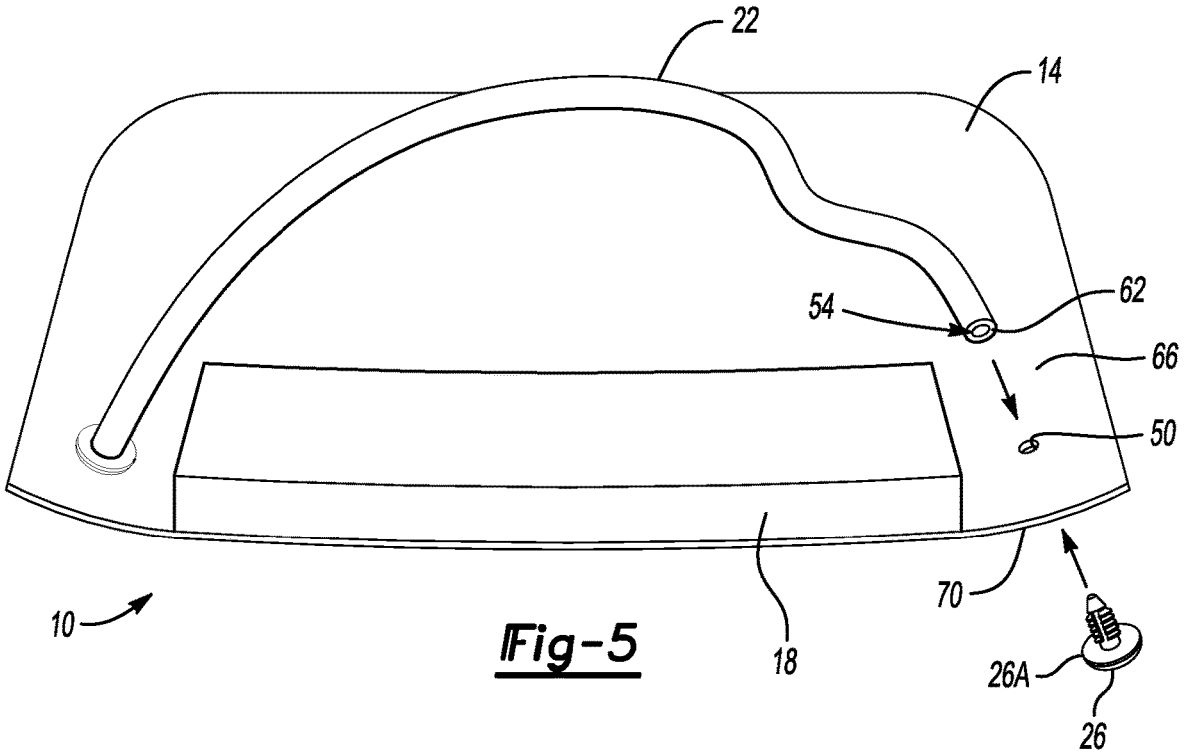
FIG. 5 illustrates the face shield assembly of FIG. 1 during assembly.
Figure 6:
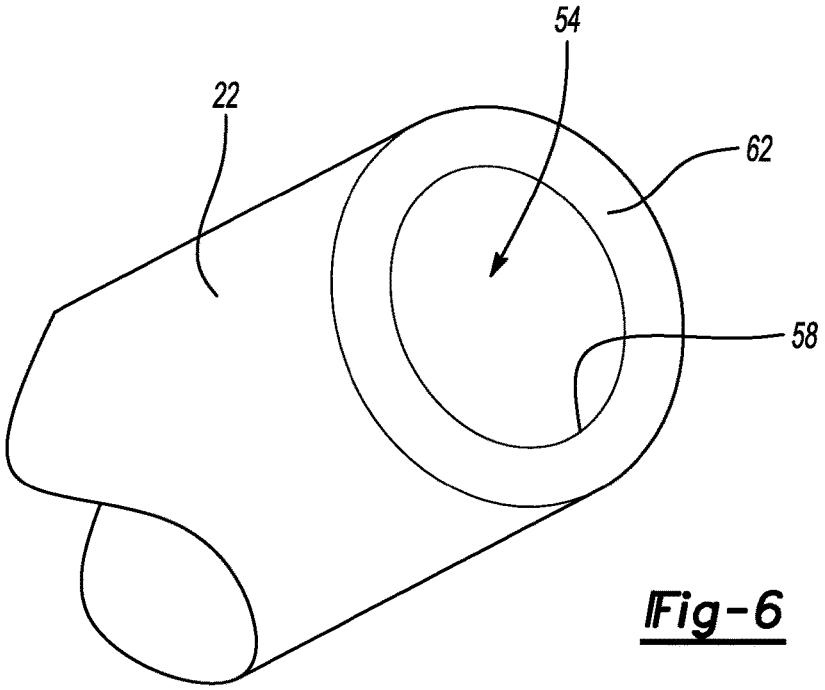
FIG. 6 illustrates a close up view of an end of a hose from the face shield assembly of FIG. 7 illustrates a close up view of the hose of FIG. 6 being shortened to accommodate a different user.

With reference now to FIGS. 5 and 6 and continuing reference to FIGS. 1-4, the shield 14 includes an aperture 50 associated with each of the fasteners 26. The apertures 50 can be cut into the shield 14 when the shield 14 is die cut from the sheet 38.

When the fasteners 26 are binding the tube 22 to the shield 14, the ribbed shank 46 extends through the aperture 50 into an interior 54 of the tube 22. In the exemplary embodiment, ribs of the ribbed shank 46 press against an inner diameter 58 of the tube 22 to hold the tube in 22 a position bound to the shield 14.

Tube, for purposes of this disclosure, refers to elongated, hollow cylindrical structures. The tube 22 differs from bands of elastic due to, among other things, the tube 22 having the interior 54, which is a bore or hollow extending the length of the tube 22.

In the exemplary embodiment, an end face 62 of the tube 22 contacts an inner surface 66 of the shield 14 when the fasteners 26 are binding the tube 22 to the shield 14. The fastener head 42 of the fastener 26 contacts an outer surface 70 of the shield 14. The fastener head 42 has a diameter that is oversized relative to the aperture 50 to prevent the fasteners 26 from pulling through the respective apertures 50. The ribbed shanks 46 do not directly contact the temple areas of the head 34 because the ribbed shanks 46 extend into the interior 54 of the tube 22. Blocking the ribbed shanks 46 from contacting the temple areas of the head 34 can prevent the fasteners 26 from irritating the user.

In another example, the fastener heads 42 could be placed against the inner surface 66 of the shield 14 with the ribbed shanks 46 projecting outward. In such a configuration, the end face 62 of the tube 22 contacts the outer surface 70 of the shield 14.

Further, in another example, the bumper 18 could extend into the area of the aperture 50, and the rubbed shank 46 could extend through the aperture 50 in the shield 14 along with an aperture in the bumper 18.

The bumper 18 and the tube 22, in the exemplary embodiment, have a relatively high coefficient or friction to help keep the face shield assembly 10 in place on head 34 of the user.

Figure 7:
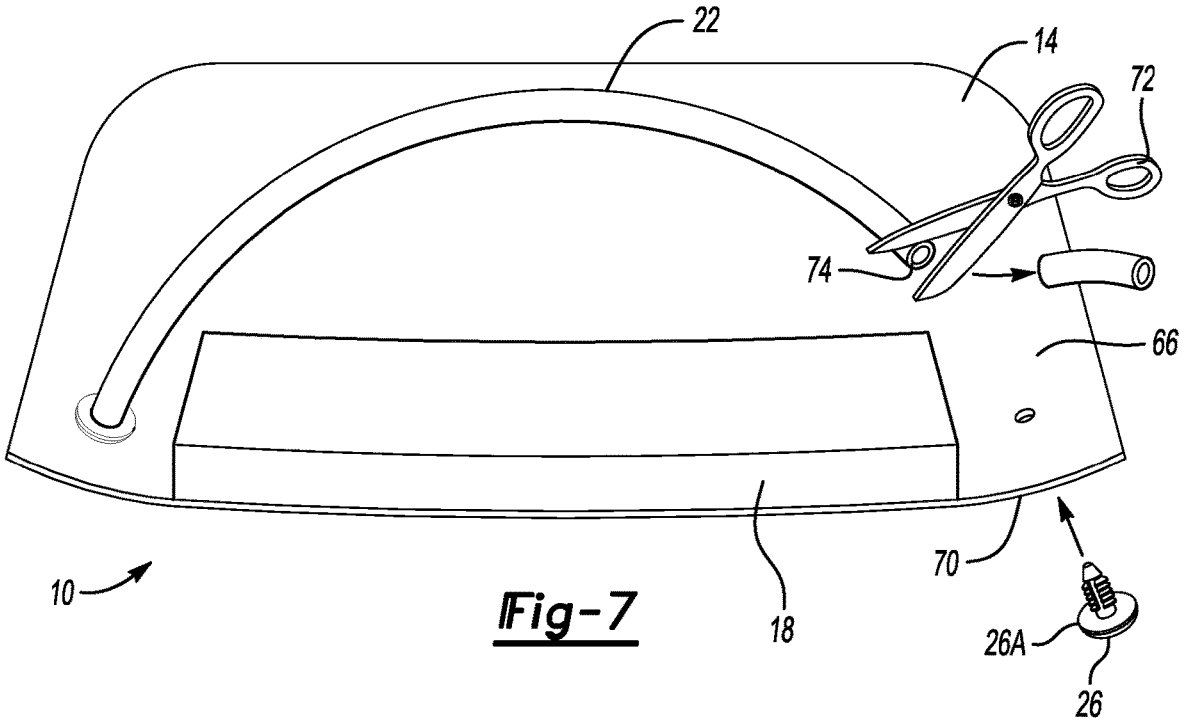

Referring now to FIG. 7, if the face shield assembly 10 can be adjusted so that the face shield assembly 10 can be used by a user with a head smaller than the head 34 shown in FIGS. 1 and 2. To adjust the face shield assembly 10, the user can shorten the tube 22.

First, the user withdrawns the fastener 26A from the tube 22. The user can, for example, rotate the tube 22 relative to the fastener 26A while pulling the two apart. Once separated, the user can shorten the tube 22. Here, scissors 72 are used to cut the tube 22 so that the tube 22 is shorter. The tube 22, once shortened, is then bound to the shield 14 with the fastener 26 such that a cut end face 74 of the tube 22 directly contacts the shield 14. The face shield assembly 10 can then fit a user with a smaller head size.

Figure 8:
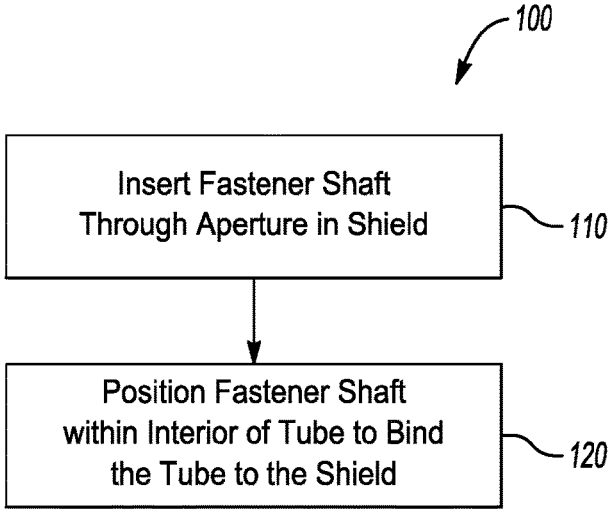
FIG. 8 illustrates a flow of a face shield assembling method according to an exemplary aspect of the present disclosure.

With reference to FIG. 8 and continuing reference to FIGS. 1-6, a flow of an example face shield assembly method 100 begins at a step 110 where a shaft of a fastener is inserted through an aperture in a shield. At a step 120, the shaft of the fastener is then positioned within an interior of a tube to bind the the tube to at least the shield.

Features of the disclosed embodiments can include a face shield assembly that is relatively simple to adjust so that users of various sizes can use the same standard face shield assembly. The face shield assembly uses a tube rather than an elastic band. Elastic bands can stretch out relatively quickly.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A face shield assembly, comprising:

a shield configured to be placed adjacent a front of a head of a user;

a tube configured to be placed against a rear of the head of the user; and a plurality of fasteners, each fastener within the plurality of fasteners binding the tube to at least the shield, wherein the tube extends longitudinally from a first end face to a second end face, the first and second end faces directly contacting the shield when the plurality of fasteners are binding the tube to at least the shield, wherein each of the fasteners within the plurality of fasteners extends into an interior of the tube when binding the tube to at least the shield, wherein each of the fasteners within the plurality of fasteners extends through a respective aperture in the shield.

2. The face shield assembly of claim 1, wherein the plurality of fasteners are a plurality of push-in rivets.

3. The face shield assembly of claim 1, further comprising a bumper configured to be placed against the front of the head of the user, the bumper extending continuously from a left temple of the user to a right temple of the user.

4. The face shield assembly of claim 3, wherein the bumper is a foam material.

5. The face shield assembly of claim 1, wherein the tube is an elastic tube.

6. A face shield assembly, comprising:

a shield configured to be placed adjacent a front of a head of a user;

a tube configured to be placed against a rear of the head of the user; and a plurality of fasteners, each fastener within the plurality of fasteners binding the tube to at least the shield, wherein the tube extends longitudinally from a first end face to a second end face, the first and second end faces directly contacting the shield when the plurality of fasteners are binding the tube to at least the shield, wherein each of the fasteners within the plurality of fasteners extends through a respective aperture in the shield.

7. The face shield assembly of claim 6, wherein the first and second end faces directly contact an inner surface of the shield when binding the tube to at least the shield, wherein the inner surface of the shield faces the head of the user when the user is wearing the face shield assembly.

* * * * *